US006415755B1

(12) United States Patent
McCarthy

(10) Patent No.: US 6,415,755 B1
(45) Date of Patent: Jul. 9, 2002

(54) VALVE CLEARANCE ADJUSTING TOOL AND METHOD FOR ADJUSTING VALVE CLEARANCE

(76) Inventor: Joseph W. McCarthy, 390 Amapola Ave., Unit No. 2, Torrance, CA (US) 90501

( * ) Notice: Subject to any disclaimer, the term of this patent is extended or adjusted under 35 U.S.C. 154(b) by 14 days.

(21) Appl. No.: 09/634,188

(22) Filed: Aug. 9, 2000

(51) Int. Cl.[7] ..... B23P 19/04

(52) U.S. Cl. ..... 123/90.52; 29/888.011; 29/213.1; 81/484; 123/90.1

(58) Field of Search ..... 123/90.1, 90.52; 29/888.011, 213.1, 214, 215, 217; 81/484

(56) References Cited

U.S. PATENT DOCUMENTS 3,977,064 A * 8/1976 Mote et al. ..... 29/216
3,979,811 A * 9/1976 Kammeraad ..... 29/215
4,292,719 A * 10/1981 Britton, Jr. ..... 29/888.011
4,446,608 A * 5/1984 Johnson ..... 29/220
4,461,062 A * 7/1984 Melzer et al. ..... 29/888.42
5,499,434 A * 3/1996 Zdral ..... 29/220
6,205,850 B1 * 3/2001 Wehrman et al. ..... 73/119 R

* cited by examiner

*Primary Examiner*—Weilun Lo
(74) *Attorney, Agent, or Firm*—Thomas A. Turner, Jr.

(57) ABSTRACT

Valve clearance adjusting shims in an internal combustion engine having an overhead cam, are removed and replaced by compressing a valve spring through a cam follower forcibly held against the spring pressure by a valve clearance tool. A method for relieving pressure against the valve spring and for replacing the valve clearance adjusting shims is described.

7 Claims, 2 Drawing Sheets

VALVE CLEARANCE ADJUSTING TOOL AND METHOD FOR ADJUSTING VALVE CLEARANCE

BACKGROUND OF THE INVENTION

1. Field of the Invention

The present invention relates to the art of adjusting valve clearances in an overhead cam internal combustion engine, and more particularly to the method and apparatus for back biasing the valve spring.

2. Background of the Invention

In internal combustion engines, air is taken into, and forced out of the combustion chambers through carefully timed operation of valves opened and closed in a combustion cycle or Otto cycle, in most designs by cam lobes mounted on, or integral with, camshafts. The valves seat within the air intake or exhaust ports, and are opened on the engagement of a cam lobe with the valve assembly, by engaging a cam follower which is connected with a valve spring through a valve spring retainer. The cam lobe engages the cam follower either directly, as through a shim, or indirectly, which is usually through a rocker arm assembly. The valve spring biases the valve into the closed position, in which position the valve head is seated within the port. Because of the great number of repetitive valve operations during the cycles of the camshaft during operation, the valve head wears on the valve seat structure and itself, so that the valve head will, with time, sit deeper within the valve seat in the cylinder head.

When the valve seating structure deteriorates, it is likely that the. valve will seat too far within the seating structure, reducing the clearance between the cam and the cam follower. Correction of the clearance can be accomplished by replacing the cam follower shim or other clearance adjusting instrument. Moreover, the clearance between the cam and the cam follower is sometimes important in fine tuning an engine for special performance.

The pressure on the cam follower-to-cam lobe interface passes through the shim or similar device. When it is desired to adjust the cam-to-cam follower clearance, either for maintenance or for performance reasons, the adjustment therefore is normally made by replacing the shim or similar device. To make such a replacement, it is necessary to obtain relief from the valve spring pressure.

Furthermore, the shim is very small, and normally is placed in a very inaccessible location. The shim, for example, is on the order of 0.150 inches thick. The pressure on the shim is on the order of, e.g. 160 to 220 pounds per square inch ("psi") the pressures are on the order of as much as 600 psi.

Various methods and tools have been designed to assist the automobile mechanic in relieving the valve spring pressure. For example, Kammeraad, U.S. Pat. No. 3,979,811 teaches an overhead camshaft and valve tool that can be attached to the cylinder head, the ultimate objective of which is to relieve the pressure of the cams on the cam followers. The tool must be attached first to the cylinder head below the cam shaft, with shoes that each has a flange that must be positioned laterally of the cam followers. The flanges must be inserted between the cam shaft and the cam followers so that the flange in each case will be engaged by a corresponding cam lobe to depress the corresponding cam follower and valve spring. A bolt for each cam follower is positioned in a space adjacent to the cam follower but not in-line or over the cam follower, and is selectively connected to the flange through the shoe, which is rotated about a fulcrum in the form of a rod. When the cam lobe for each cam engages its corresponding cam follower through the flange, the bolt is then screw-turned into a position to maintain its corresponding cam follower in the depressed position against the valve spring's bias. Each cam follower is made to be depressed in like manner. The camshaft, with all of the valve springs' pressure thus relieved, can then be removed.

Other tools for relieving the pressure on the cam follower from the valve springs, are shown and described in, for examples, Mote, et al., U.S. Pat. No. 3,977,064, Johnson, U.S. Pat. No. 4,446,608 and Zdral, U.S. Pat. No. 5,499,434. Mote. et al. teaches a series of steps for the removal and replacement of a valve spring assembly in a push rod and rocker arm motor. The push rod must be removed and the rocker arm must be disengaged, after which a plate is inserted over a pair of valve springs, and a threaded shaft is used to move the plate and consequently the pair of springs against their bias.

In each of the Johnson and the Zdral teachings, an elongated lever is rotated about a line of rotation to depress the valve spring. In Johnson, the lever is hooked onto a pivot shaft and a leg attached to the other end of the lever engages the retainer for the spring which is depressed. In Zdral, the lever is hooked around the camshaft itself, making the camshaft itself act as the pivot line. Another location on the lever engages a depressor member which depresses a retainer connected to the valve spring. Upon rotating the lever about the pivot line, the depressor member depresses the spring's retainer. In both of these devices, as well as in the device of Kammeraad, identified above, the lever must be locked in the spring-depressed mode to prevent the spring from applying pressure back against the cam or cam lobe. It has been known for the locking mechanism to surprise the mechanic and become unlocked. The result can be injury as well as sore knuckles.

In many engine designs, furthermore, there is no space or room for an elongated lever to be inserted into the cavity around the shim's location.

It is still desired, therefore, to provide a valve spring pressure relief apparatus that can be mounted so as to contact the valve spring cam follower directly, without the necessity of removing any part in the linkage between the cam lobe and the cam follower before the replacement of any part. It is desired, further, to provide a valve spring pressure relief apparatus that has a direct, or straight line of pressure without the necessity of having pressure transferring apparatus that is articulated around the camshaft. It is desired, furthermore, to provide a valve spring pressure relief apparatus that does not rely upon the working of a lever about a fulcrum or pivot line. Yet further, it is desired to provide a valve spring pressure relief apparatus which, when depressing the valve spring, does not require a locking mechanism to remain and be maintained in the spring-depressed state.

SUMMARY

In brief, in accordance with one aspect of the present invention, a valve clearance adjusting tool has a body which is mountable onto a cam bearing cap of an overhead cam internal combustion motor. A threaded screw is selectively moveable in a linear direction through the body of the valve clearance adjusting tool, to linearly position a dowel pin and its foot positioned linearly to the threaded screw. The valve clearance adjusting tool is removably mounted to a cylinder head through a cam bearing cap by an already existing cam bearing cap bolt. The methods of the present invention include the engagement by the dowel pin foot directly onto a corresponding cam follower on its edge without engaging the clearance adjustment shim, by way of movement of the threaded screw to depress the valve spring against the spring's bias, thereby enlarging the space between the cam follower and the cam and allowing better ease of access to the shim positioned on the head of the cam follower.

Other novel features which are .believed to be characteristic of the invention, both as to organization and methods of operation, together. with further objects and advantages thereof, will be better understood from the following description in which preferred embodiments of the invention are described by way of example.

DESCRIPTION OF THE PREFERRED EMBODIMENT

Figure 1:
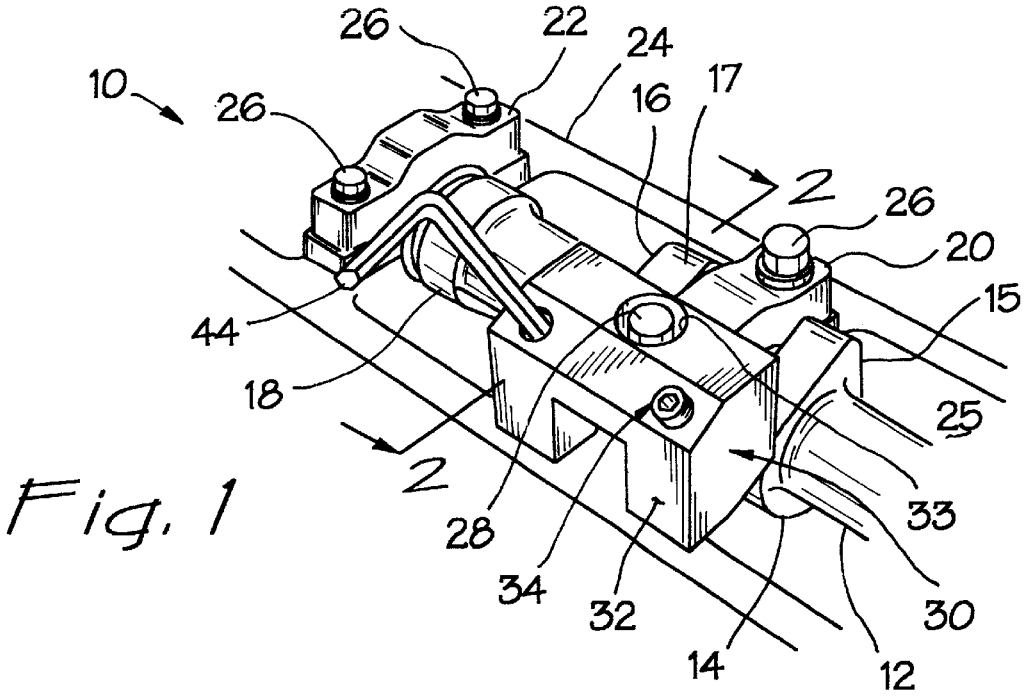
FIG. 1 is a perspective view of a section of a camshaft in a dual overhead cam motor showing mounted therein a valve clearance adjusting tool in accordance with the preferred embodiment of the present invention.

Referring initially to FIG. 1 of the accompanying drawings, where reference numerals correspond to like numerals used in this specification, a section 10 of a dual overhead cam motor is shown having a camshaft 12 rotatably mounted within it. The camshaft 12 has a cam 14 with a lobe 15, and a cam 16 having a lobe 17. In the view of FIG. 1, a third cam 18 is also shown. The camshaft 12 is held onto the cylinder head 24 by, among other things, a series of cam bearing caps including cam bearing caps 20, 22. The cylinder head 24 has a space or recess 25 in which the camshaft 14 operates. The cam bearing caps 20, 22 are secured to the cylinder head 24 by cam bearing cap retention bolts 26, 28.

A valve clearance adjusting tool 30 in accordance with the preferred embodiment of my invention includes a body 32, also shown in FIG. 1. The tool body 32 has an attaching bolt hole 33 and a pair of threaded holes, each for receiving a threaded adjusting screw assembly or threaded member assembly 34. An Allen wrench 44 for turning a screw or threaded member 36 of the screw or threaded member assembly 34 is depicted engaged with one of the threaded adjusting screw assemblies 34.

In the view of FIG. 1, the cam bearing cap bolt 28 is inserted through the attaching bolt hole 33 of the valve clearance adjusting tool 30 and through the cam bearing cap 20, and is threaded into the cylinder head 24 to secure the adjusting tool 30 and the cam bearing cap 20 to the cylinder head 24.

Figure 2:
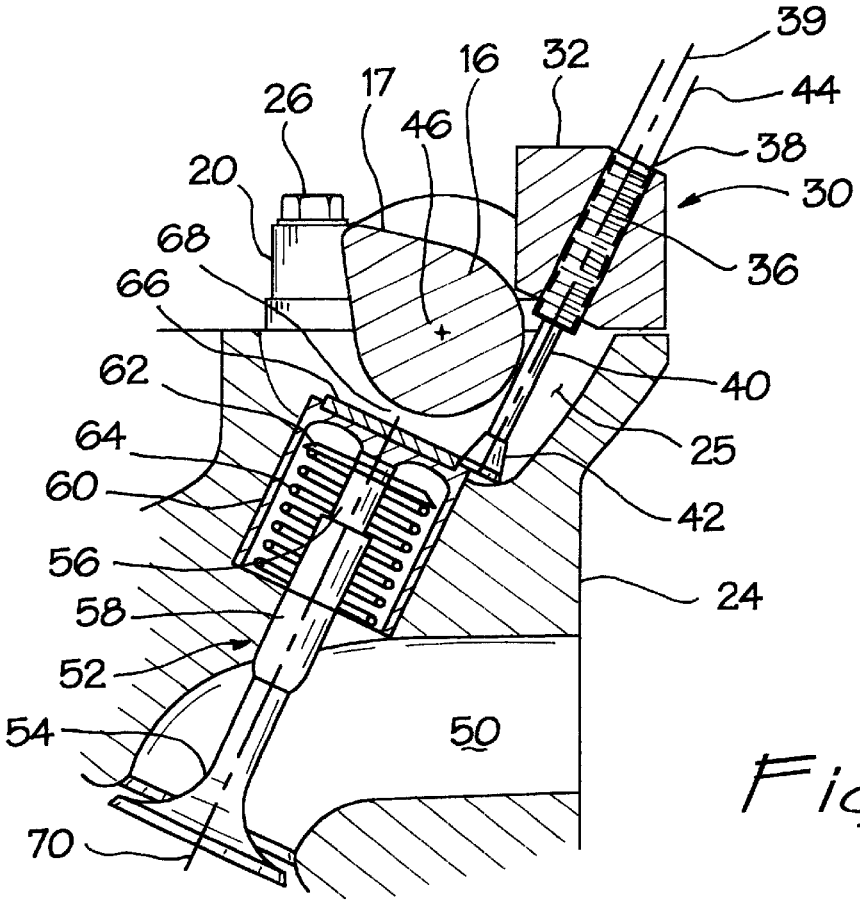
FIG. 2 is a cross-section elevation of the camshaft section taken along line 2—2 in the perspective of FIG. 1.

As better seen in the cross-section, elevation view of FIG. 2, each of the threaded adjusting screw assemblies 34 is comprised of a screw portion or threaded member 36, a hollow hex socket head 38 for receiving an Allen wrench 44, a dowel pin 40 and a foot 42 forming the end of the dowel pin 40. The valve clearance adjusting tool 30 is shown in FIG. 2 positioned abutting the cylinder head 24. The body 32 of the tool 30 has received the screw or threaded member 36 of the adjusting screw assembly or threaded member assembly 34. The screw or threaded member 36 moves axially, when turned, along the axis of centerline 39.

The cam 16 with its lobe 17 rotate about the axis of centerline 46. The cylinder head 24 has a port 50, here shown as an exhaust port. A poppet valve 52 is made within the cylinder head 24, the valve 52 having a valve head, a valve stem 56 and a valve guide 58. The valve is seated within a cam follower 60. A spring retainer 62 is fixed on the valve stem 56, to retain the valve spring 64. The valve spring 64 is seated fixed to the cylinder head 24 at the lower end as shown in FIG. 2, so as to bias normally the valve head 54 in the closed position. A valve clearance adjusting shim 66 is positioned on the cap of the cam follower 60 to be engaged by the lobe 17 of the cam 16 in the rotation cycles of the camshaft 12.

The dowel pin 40 and its foot 42, as depicted in the view of FIG. 2, have been advanced axially along centerline 39 by turning of the screw or threaded member 36 so that the foot 42 has traveled through the cylinder head space 25 to abut or engage the cam follower 60 at its head. The foot 42 has been advanced so as to move the cam follower 60 axially along the centerline 70 and consequently to depress the valve spring 64.

Figure 3:
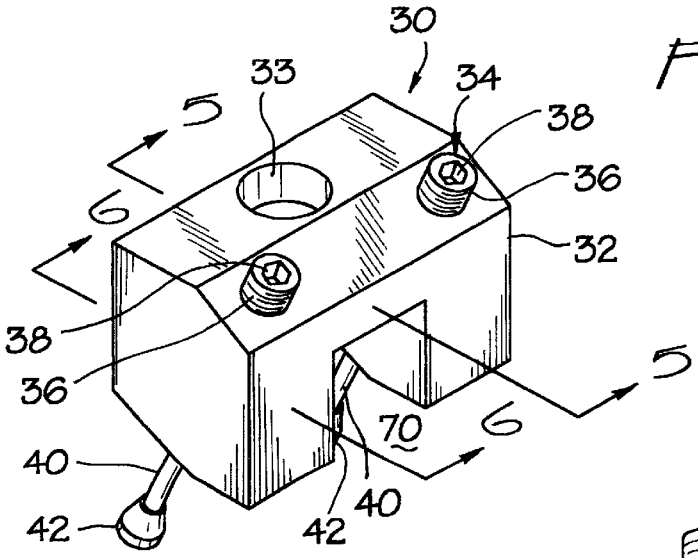
FIG. 3 is a perspective view of a valve clearance adjusting tool in accordance with the preferred embodiment of my present invention not mounted.
Figure 4:
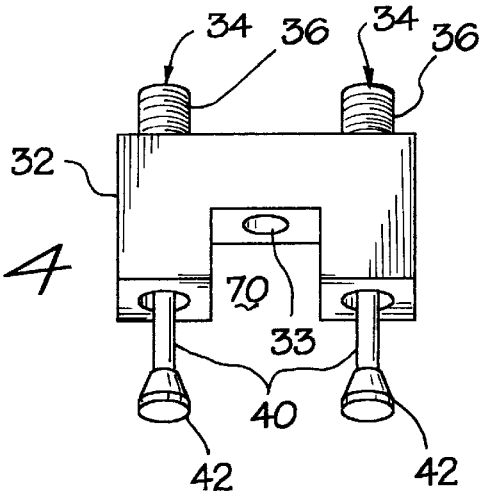
FIG. 4 generally bottom view of the preferred embodiment of my invention as seen in FIG. 3.
Figure 5:
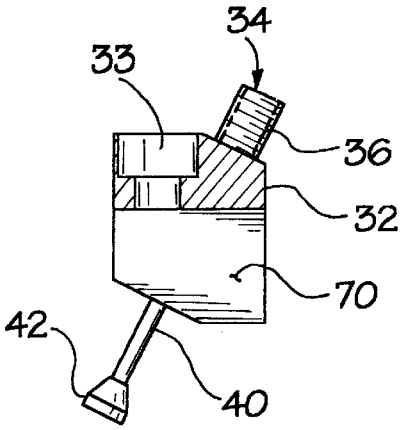
FIG. 5 is a cross-section, elevation view of the preferred embodiment of my invention, taken along line 5—5 of the view of FIG. 3; and, FIG. 6 is a cross-section, elevation view of the preferred embodiment of my invention taken along line 6—6 of the view of FIG. 3.

The valve clearance adjusting tool 30 of the preferred embodiment of the present invention is seen more clearly in the perspective views of FIGS. 3 and 4, where the tool 30 is shown separate and apart from its position within the cylinder head 24 of FIGS. 1 and 2, above. In FIG. 3, a perspective view seen from above the tool 30, the body 32 of the tool 30 has the attaching bolt hole 33. As seen better in FIG. 4, which is a perspective view seen from the bottom of the tool 30, and in FIG. 5, which is a cross-section, elevation view taken along line 5—5 of FIG. 3, the hole 33 extends through the tool body 32. The tool body 32 is shaped so as to provide a generally U-shape, defining a space 70 for fitting over the cam bearing cap, the bearing cap not being shown in these FIGS. 3 and 4.

Figure 6:
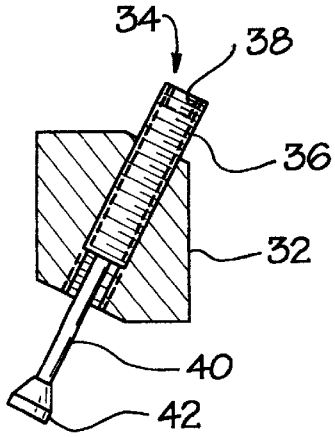

The pair of adjusting screw assemblies 34 are shown threaded through the tool body 32, best seen in FIG. 6 of the drawings, having the dowel pins 40.and the connected feet 42 extending beyond the tool body 32. The threaded members or screws 36 have the hexagonally shaped head 38, seen best in FIG. 3, for receiving an hexagonal Allen wrench 44. The screws or threaded members 36 as shown in FIGS. 3, 4, 5 and 6 have been turned so as to recede the assemblies 34 back through the tool body 32 from the position as shown in FIGS. 1 and 2.

In operation, cam bearing bolt 28 is removed from the cam bearing cap 20. The valve clearance adjusting tool 30 then is positioned over the cam bearing cap 20, which fits within the space 70 of the tool body 32. The cam bearing cap bolt 28 then is inserted through the attaching bolt hole 33 and through the cam bearing cap 20 to mount, removably, the valve clearance adjusting tool 30 to the cylinder head 24.

An hexagonal Allen wrench 44 is inserted into the hexagonally shaped socket head 38 of the threaded member or screw 36, and turned to advance the adjusting screw assembly or threaded member assembly 34 into the space 25 of the cylinder head 24. By continuing the advance of the screw assembly 34, the foot 42 attached to the dowel pin 40, in turn attached to the screw or threaded member 36, engages the cam follower 60 but not the adjusting shim 66. The cam follower 60 thus depresses the valve spring 64 to create a separation space 68 between the cam 16 and the cam follower 60 and to expose the adjusting shim 66 to being handled through the spaces 25, 68. The separation space 68 is on the order of 0.23 inch, and thus presents sufficient space to dislodge the adjusting shim 66. The adjusting shim 66 is then removed, and a new adjusting shim 66 is inserted in its place.

The Allen wrench 44 then is turned retrogressively to recede the screw assembly 34 back upwardly, and to allow the valve spring 64 to force, through the retainer 62, the cam follower 60 back to its normal, biased position to seat the valve head 54 closing the port 50. The valve clearance adjusting tool 30 is then removed from the cylinder head 24 by first retrogressively turning the cam bearing bolt 28 and freeing the tool 30. The tool 30 is removed from over the cam bearing cap 20, and the cam bearing bolt 28 is re-inserted into the cam bearing cap 20 to secure the cam bearing cap 20 back to the cylinder head 24.

In the normal operation of the internal combustion engine, the camshaft 12 rotates, in turn rotating the cams 14, 16, 18 and cam lobes 15, 17. In the combustion cycle or Otto cycle, the cam lobe 17 will engage the adjusting shim 66 once each cycle to depress the cam follower 60 against the pressure bias of the valve spring 64. The cam follower 60, with the appurtenant cam follower head and valve 52, thus will move reciprocally back and forth in opposing directions along the axis 70, best seen in FIG. 2 of the drawings. The axial alignment of the threaded member assembly or adjusting screw assembly 34 is indicated by centerline 39 in FIG. 2. The centerline 39 is substantially parallel to the axis 70 of the valve 52 and cam follower 60.

It may be seen that in the complete operation of removing the adjusting shim 66, no normal operating component of the engine is removed, except of course for the adjusting shim 66 itself. Moreover, no operating component is moved except in a course and direction of movement which that component normally moves in the Otto cycle.

The foregoing detailed description of my invention and of preferred embodiments thereof as to products, compositions and processes, is illustrative of specific embodiments only. It is to be understood, however, that additional embodiments may be perceived by those skilled in the art. The embodiments described herein, together with those additional embodiments, are considered to be within the scope of the present invention, which is to be limited only by the appended claims.

I claim:

1. A method for removing and replacing a valve clearance adjusting shim positioned on a head of a cam follower in an overhead cam engine comprising a camshaft, a cylinder head, a pressure biased cam follower and a valve having an axis and reciprocally moving along an axial direction, comprising the steps of:

a. establishing means for holding an elongated, threaded member in close proximity to a cylinder head in substantial axial alignment with the reciprocal movement of said cam follower;

b. positioning in substantially axial alignment with said reciprocal movement of said cam follower, a threaded member assembly means comprising an elongated threaded member having an axial alignment and a foot, for moving said cam follower against the pressure bias of said cam follower; and, c. axially moving said elongated threaded member into engagement with said head of said cam follower and axially moving said cam follower against the pressure bias of said cam follower to create a separation space between said head of said cam follower and said camshaft and between said adjusting shim and said camshaft.

2. The method of claim 1 further comprising the step of removably mounting in proximity to said cylinder head, valve clearance adjusting tool means for holding said elongated, threaded member in close proximity to said cylinder head.

3. The method of claim 1 wherein in said axially moving step, said threaded member is moved in a direction parallel to the reciprocal movement of said cam follower.

4. A method for removing and replacing a component in an internal combustion engine having a cylinder head, having a pressure biased valve having an axis, and having a camshaft having at least one cam having a cam lobe that at least indirectly causes said valve to move against its pressure bias reciprocally along its axial direction in a combustion cycle, comprising the steps of:

a) establishing means for holding an elongated, threaded member in close proximity to a cylinder head in substantial axial alignment with the reciprocal movement of said valve without moving any component of said engine except as that component normally moves in the combust ion cycle;

b) positioning in substantially axial alignment with said reciprocal movement of said valve, a threaded member assembly means comprising an elongated threaded member having an axial alignment and a foot, for moving said valve against the pressure bias of said valve; and, c) axially moving said elongated threaded member into at least indirect engagement with said valve and axially moving said valve against the pressure bias of said valve to create a separation space.

5. A valve clearance adjusting tool for relieving pressure of a pressure biased cam follower and cam follower head against a clearance adjusting shim in an overhead cam engine, comprising:

a) an overhead cam engine having a camshaft having at least one cam having a cam lobe and having at least one cam follower and a cam follower head pressure biased to reciprocally move in an axial direction upon engagement and disengagement by said cam lobe;

b) positioning means for movably positioning at least one axially elongated, threaded member assembly comprising a threaded member and a foot in substantially parallel alignment with said reciprocal movement of said cam follower, and in such close proximity to said cam follower head that said foot will engage and move against said pressure bias of said cam follower and cam follower head when said axially elongated, threaded member is moved in one of said reciprocal axial directions.

6. The valve clearance adjusting tool of claim 5 where said positioning means further comprises mounting means removably mounted in a predetermined position in relation to said cylinder head, for threadedly receiving said elongated threaded member assembly and maintaining said elongated threaded member assembly in an alignment substantially parallel with an axis of said reciprocal axial directions.

7. A tool for relieving the pressure of a pressure biased valve in an internal combustion engine having a cylinder head, having a pressure biased valve having an axis, and having a camshaft having at least one cam having a cam lobe that at least indirectly causes said valve to move against its pressure bias reciprocally along its axial direction in a combustion cycle, comprising:

a) an internal combustion engine having a combustion cycle, having a camshaft having at least one cam having a cam lobe and having at least one valve pressure biased to reciprocally move in an axial direction upon engagement and disengagement by said cam lobe;

b) positioning means for movably positioning at least one axially elongated, threaded member assembly comprising a threaded member and a foot in substantially parallel alignment with said reciprocal movement of said valve, and in such close proximity to said valve that, when said axially elongated, threaded member is moved in one of said reciprocal axial directions, said foot will at least indirectly engage and move against said pressure bias of said valve without moving any component of said engine except as that component normally moves in the combustion cycle.

* * * * *